US009475617B2

(12) United States Patent
Ho

(10) Patent No.: US 9,475,617 B2
(45) Date of Patent: Oct. 25, 2016

(54) EXTRUDER

(71) Applicant: HON HAI PRECISION INDUSTRY CO., LTD., New Taipei (TW)

(72) Inventor: Tung-Fa Ho, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/591,436

(22) Filed: Jan. 7, 2015

(65) Prior Publication Data

US 2016/0075482 A1 Mar. 17, 2016

(30) Foreign Application Priority Data

Sep. 11, 2014 (CN) ..... 2014 1 0458583

(51) Int. Cl.
*B65D 35/28* (2006.01)

(52) U.S. Cl.
CPC ..... *B65D 35/28* (2013.01)

(58) Field of Classification Search
CPC ..... B65D 35/28
USPC ..... 222/103, 95
See application file for complete search history.

(56) References Cited

U.S. PATENT DOCUMENTS 3,248,012 A * 4/1966 Adams ..... B65D 35/28 222/95
4,159,787 A * 7/1979 Wright ..... B65D 35/28 222/103
4,576,314 A * 3/1986 Elias ..... B65D 35/32 222/103
5,167,348 A * 12/1992 Okami ..... B65D 35/28 222/102
6,155,458 A * 12/2000 Picard ..... B65D 35/28 222/103

FOREIGN PATENT DOCUMENTS

CN 201128530 Y * 10/2008
JP 2010228771 A 10/2010

* cited by examiner

*Primary Examiner* — Donnell Long
(74) *Attorney, Agent, or Firm* — Zhigang Ma

(57) ABSTRACT

An extruder includes a first clamping plate, a second clamping plate, a connecting plate rotatably interconnecting the first and second clamping plate, a latching member, and a positioning protrusion. The latching member is formed on an end of the first clamping plate. The positioning protrusion is formed on an end of the second clamping plate, matching with the latching member to latch the first and second clamping plate.

8 Claims, 4 Drawing Sheets

EXTRUDER

FIELD

The subject matter herein generally relates to extruders, and in particular to an extruder used to squeeze contents packaged in tooth paste tubes.

BACKGROUND

Toothpaste for consumer use has long been sold in tubes requiring the user to squeeze part of the tube to extract the paste from a spout at one end of the tube.

BRIEF DESCRIPTION OF THE DRAWINGS

Implementations of the present technology will now be described, by way of example only, with reference to the attached figures.

DETAILED DESCRIPTION

Figure 1:
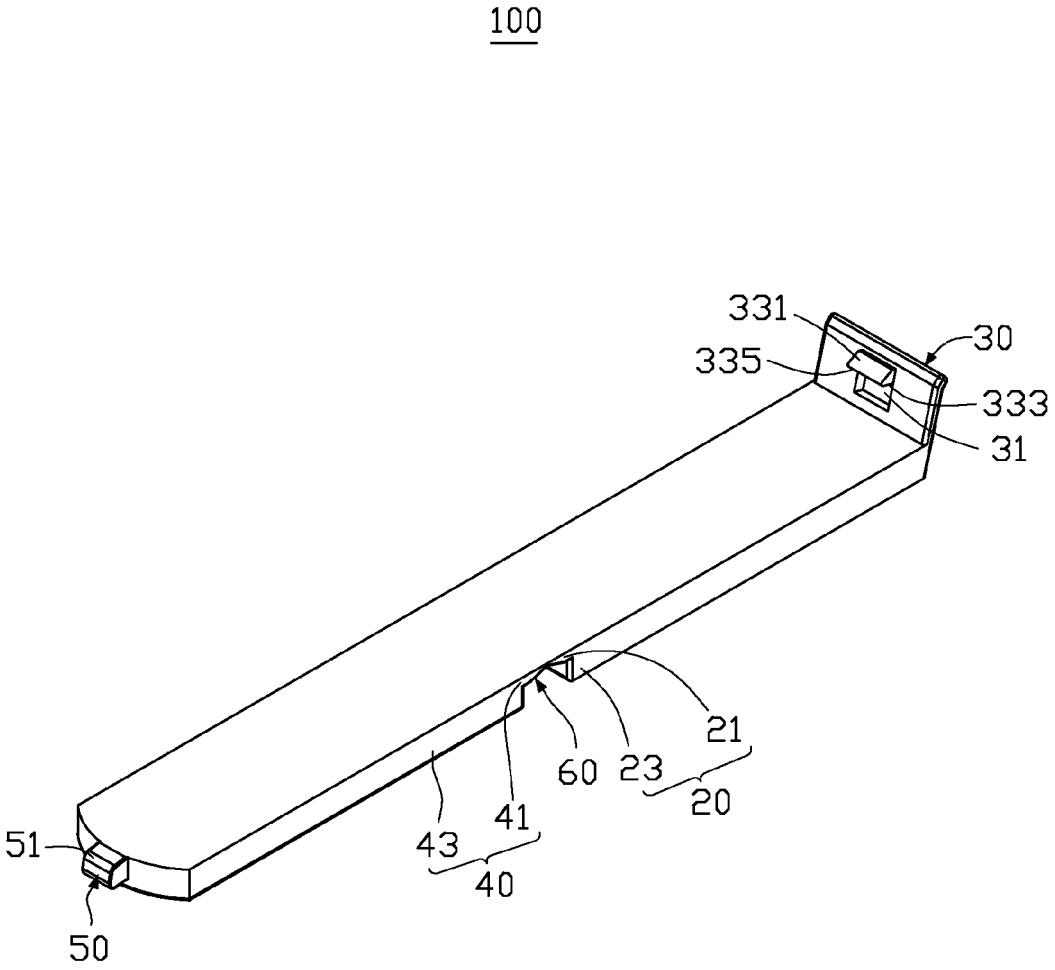
FIG. 1 is an isometric view of an embodiment of an extruder.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

An extruder can include a first clamping plate, a second clamping plate, a connecting plate rotatably interconnecting the first and second clamping plate, a latching member, and a positioning protrusion. The latching member can be formed on a side of the first clamping plate, and be located on an end of the first clamping plate away from the connecting plate. The latching member can define a latching hole. A resisting portion can protrude from a side of the latching member adjacent to the first clamping plate, and be positioned adjacent to a side of the latching hole away from the first clamping plate. The positioning protrusion can be formed on an end of the second clamping plate away from the connecting plate. The connecting plate can be capable of bending to move the second clamping plate toward the first clamping plate. The positioning protrusion can be capable of moving into the latching hole to resist along the resisting portion, to latch the first and second clamping plate.

Figure 2:
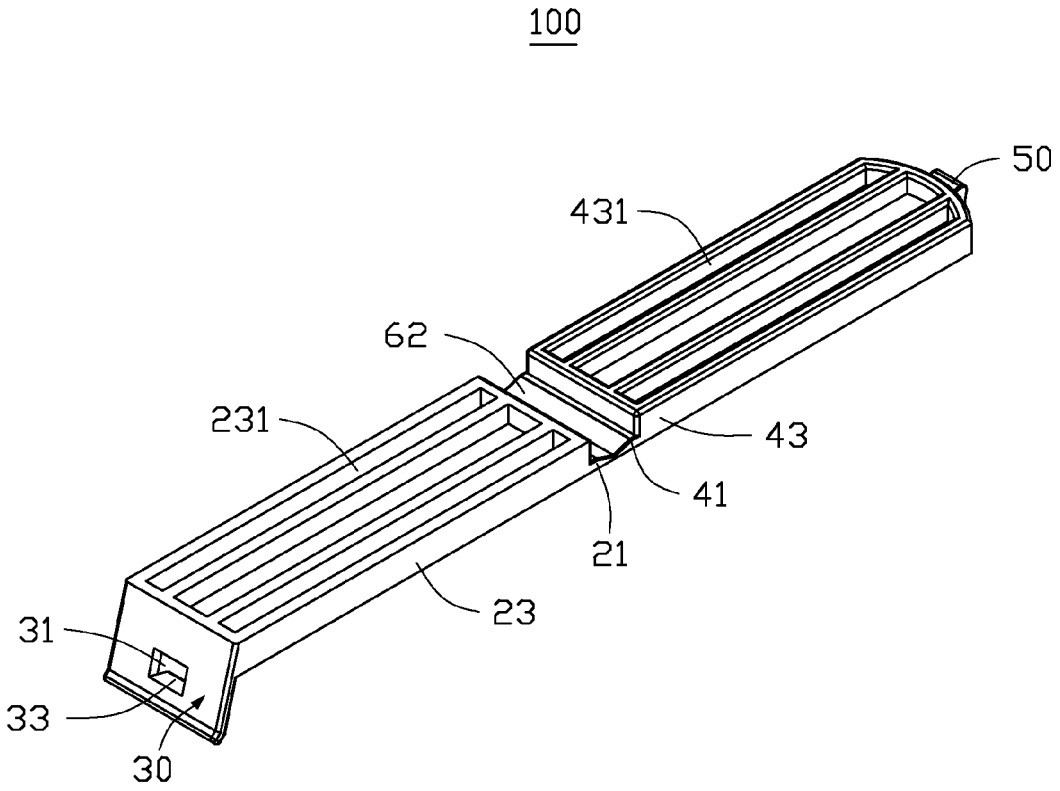
FIG. 2 is similar to FIG. 1, but viewed from another angle.

FIGS. 1 and 2 illustrate an extruder 100 configured to squeeze contents (paste like materials e. g. tooth paste) from a dispensing tube (not shown), such as a tooth paste tube. The extruder 100 can include a first clamping plate 20, a latching member 30, a second clamping plate 40, a positioning protrusion 50, and a connecting plate 60 rotatably interconnecting the first clamping plate 20 and the second clamping plate 40. The latching member 30 can be positioned on an end of the first clamping plate 20 away from the second clamping plate 40. The positioning protrusion 50 can be positioned on an end of the second clamping plate 40 away from the first clamping plate 20.

The first clamping plate 20 can be substantially a rectangular plate, and can include a base body 21 and an enforcement portion 23 perpendicularly protruding from a side of the base body 21. The base body 21 can be substantially a rectangular plate, and be made of plastic. The enforcement portion 23 can support the base body, and can be configured to strengthen the base body 21, to avoid deforming into the base body 21 under stress. The enforcement portion 23 can define a number of parallel grooves 231 on a side away from the base body 21 to decrease the material.

The latching member 30 can be substantially a rectangular plate. The latching member 30 can protrude from a side of the base body 21 away from the enforcement portion 23, and can be located on an end of the base body 21. The latching member 30 can define a rectangular latching hole 31 and a resisting portion 33 thereon. The resisting portion 33 can protrude from a side of the latching member 30 adjacent to the base body 21, and can be positioned adjacent to a side of the latching hole 31 away from the base body 21. The resisting portion 33 can include a guide surface 331, a resisting surface 333 opposite to the guide surface 331, and a connecting surface 335 interconnecting the guide surface 331 and the resisting surface 333. The guide surface 335 can incline toward a plane of the base body 21, and the angle between the guide surface 331 and the side of the latching member 30 can be a first obtuse angle. The connecting surface 335 can incline toward the base body, and the angle between the connecting surface 335 and the guide surface 331 can be a second obtuse angle different to the first obtuse angle. The resisting surface 333 can be parallel to the base body 21, and can be coplanar with a side of the latching hole 31 away from the base body 21.

The connecting plate 60 can extend from an end of the first clamping plate 20 away from the latching member 30, and can be made of flexible materials. The thickness of the connecting plate 60 can be the same as that of the base body 21. The connecting plate 60 can define a bent portion 62 on a side adjacent to the enforcement portion 23. In at least one embodiment, the bent portion 62 can be a V-shaped groove, and the connecting plate 60 can be made of plastic.

The second clamping plate 40 can be formed on an end of the connecting plate 60 away from the first clamping plate 20. The second clamping plate 40 can substantially be a rectangular plate. The length of the second clamping plate 40 can substantially be the same as that of the first clamping plate 20. The second clamping plate 40 can include a base body 41 and an enforcement portion 43 perpendicularly protruding from a side of the base body 41. The base body 41 can be substantially a plate, and be made of plastic. The length and the thickness of the base body 41 can be the same as that of the base body 21. The enforcement portion 43 can support the base body, and can be configured to strengthen the base body 41, so as to avoid deforming into the base body 41 under stress. The enforcement portion 43 can define a number of parallel grooves 431 on a side away from the base body 41 to decrease the material.

The positioning protrusion 50 can perpendicularly protrude from a same side of the base body 41 and the enforcement portion 43 away from the connecting plate 60. The positioning protrusion 50 can be substantially rectangular, and can define two arc chamfers 51.

In at least one embodiment, the first clamping plate 20, the latching member 30, the second clamping plate 40, the positioning protrusion 50, and the connecting plate 60 can be integrated via a method of injection molding. In at least one embodiment, the first clamping plate 20, the latching member 30, the second clamping plate 40, the positioning protrusion 50, and the connecting plate 60 can be respectively formed, and then can be assembled to form the extruder 100.

Figure 3:
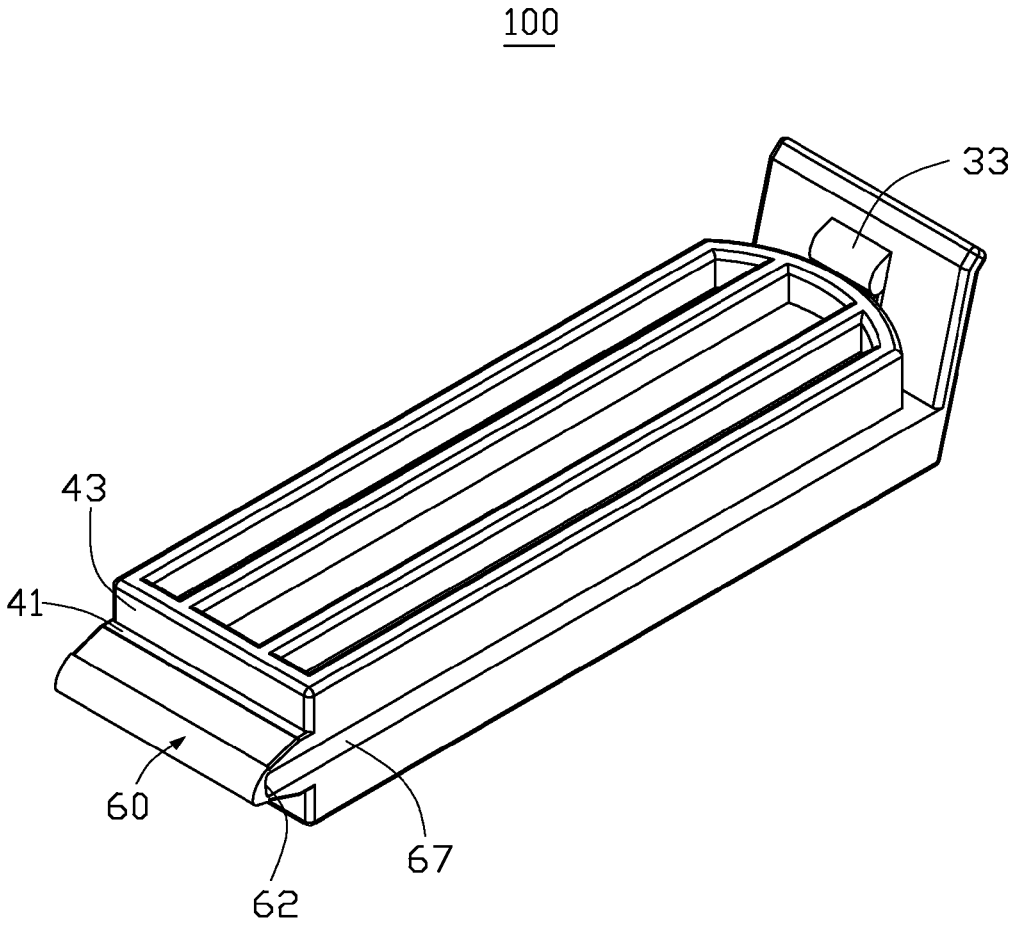
FIG. 3 is similar to FIG. 1, but showing the extruder in use.
Figure 4:
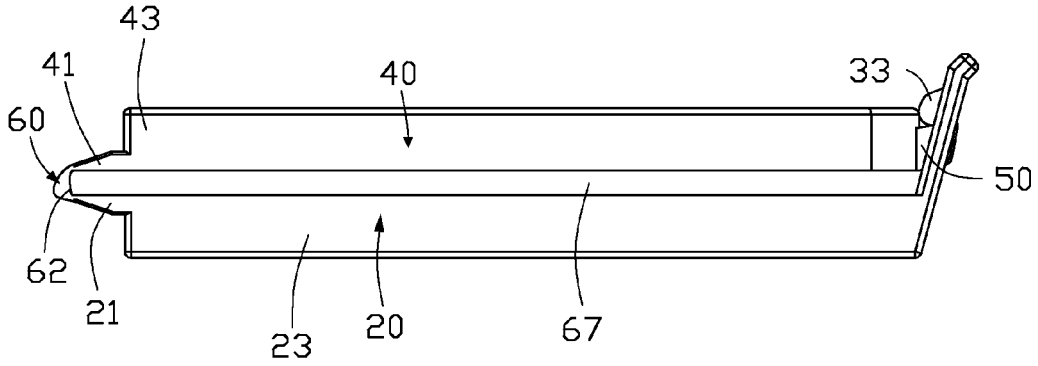
FIG. 4 is a side elevational view of the extruder of FIG. 3.

FIGS. 3 and 4 illustrate that when in use, a user (not shown) can put an end of the dispensing tube on the main body 21 of the first clamping plate 20, and then bend the connecting plate 60 to deform, so as to push the second clamping plate 40 to move toward the first clamping plate 20. When the positioning protrusion 50 resists the guide surface 331 of the resisting portion 33, the positioning protrusion 50 can further move into the latching hole 31 to resist the resisting surface 333 along the guide surface 331 and the connecting surface 335. In this way, the first clamping plate 20 can latch the second clamping plate 40. A clamp space 67 can be formed between the first clamping plate 20 and a second clamping plate 40. The dispensing tube can be received in the clamp space 67, and be compressed by the first clamping plate 20 and the second clamping plate 40. The vertical height of the clamp space 67 can be less than 3 millimeters. In other words, a distance between the first clamping plate 20 and the second clamping plate 40 can be less than 3 millimeters. And then the user can use one hand to firmly hold the end of the dispensing tube, and the other hand to move the extruder 100 toward another end of the dispensing tube. The extruder 100 can slip over the end of the dispensing tube and compress the walls of the dispensing tube together forcing the toothpaste within the dispensing tube toward the other end of the dispensing tube.

In at least one embodiment, a buffer layer (not shown) can be coated on a side of the base body (21, 41) away from the enforcement portion (23, 43) and be configured to buffer folds of the dispensing tube, leading the extruder 100 to slip smoothly. In at least one embodiment, a number of ball bearings (not shown) can be formed on the side of the base body (21, 41) away from the enforcement portion (23, 43) and be configured to decrease a contact area between the dispensing tube and the extruder, allowing the extruder 100 to slip smoothly. In at least one embodiment, a number of steel rods (not shown) can be formed in the base body (21, 41) to strengthen the base body (21, 41).

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. An extruder comprising:

a first clamping plate;

a second clamping plate;

a connecting plate rotatably interconnecting the first clamping plate and the second clamping plate;

a latching member formed on a side of the first clamping plate, located on an end of the first clamping plate away from the connecting plate, protruding obliquely to the first clamping plate at a standing state, defining a latching hole, and a resisting portion protruding from a side of the latching member adjacent to the first clamping plate and positioned adjacent to a side of the latching hole away from the first clamping plate; and a positioning protrusion formed on an end of the second clamping plate away from the connecting plate, wherein the connecting plate is capable of bending to move the second clamping plate toward the first clamping plate, and the positioning protrusion is capable of moving into the latching hole to resist along the resisting portion, to latch the first clamping plate and the second clamping plate, and the latching member keeps in the standing state when the positioning protrusion is latched.

2. The extruder of claim 1, wherein the first clamping plate comprises a base body and an enforcement portion perpendicularly protruding from a side of the base body, and the second clamping plate comprises a base body and an enforcement portion perpendicularly protruding from a side of the base body.

3. The extruder of claim 2, wherein the enforcement portion of the first clamping plate and the enforcement portion of the second clamping plate define a number of grooves on a same side, respectively.

4. The extruder of claim 1, wherein the first clamping plate and the second clamping plate cooperatively form a clamp space therebetween after latching the first and second clamping plate, and the vertical height of the clamp space is less than 3 millimeters.

5. The extruder of claim 1, wherein the connecting plate defines a bent portion on a side thereof.

6. The extruder of claim 5, wherein the bent portion is a groove.

7. The extruder of claim 1, wherein the resisting portion comprises:

a guide surface inclined to the first clamping plate;

a resisting surface opposite to the guide surface and parallel to the first clamping plate; and a connecting surface interconnecting the guide surface and the resisting surface and inclined to the first clamping plate, wherein the positioning protrusion resists the resisting surface after latching the first and second clamping plate.

8. The extruder of claim 7, wherein the positioning protrusion defines two arc chamfers on an end thereof.

* * * * *